United States Patent [19]

Bocksruker et al.

[11] 4,246,871

[45] Jan. 27, 1981

[54] STEAM GENERATOR

[76] Inventors; Ronald W. Bocksruker, 11408 Albata St., Los Angeles, Calif. 90049; Zvi H. Schachter, 5215 S. Sepulveda Blvd., Apt. 8C, Culver City, Calif. 90230

[21] Appl. No.: 36,222

[22] Filed: May 4, 1979

[51] Int. Cl.[3] ..... F22B 1/00

[52] U.S. Cl. ..... 122/4 A

[58] Field of Search ..... 122/4 A

[56] References Cited

U.S. PATENT DOCUMENTS

| | | | |
|---|---|---|---|
| 1,162,537 | 11/1915 | Yager | 122/4 A |
| 1,202,509 | 10/1916 | Burroughs et al. | 122/4 A |
| 1,408,634 | 3/1922 | Passmore et al. | 122/4 A |
| 1,707,453 | 4/1929 | Winogradow | 122/4 A |

*Primary Examiner*—Anthony V. Ciarlante

*Attorney, Agent, or Firm*—Marvin E. Jacobs

[57] ABSTRACT

A heat exchanger for an instant steam generator is disclosed comprising a small diameter, continuous metal tube formed into a closed, cylindrical helix. A heat source in contact with either surface of the helix such as a cartridge heater inserted into the helix generates steam in the water flowing in the tube. A set of thermostats in contact with each end of the helix permits fast turn on of the heater but prevents overheating and fusion of the output end of the helix.

9 Claims, 3 Drawing Figures

STEAM GENERATOR

The present invention relates to the generation of steam and, more particularly, to a small, compact, quickly responding steam generating device. Small steam generators are utilized in many manually intensive operations such as in a dentist office, dental laboratory or jewelry manufacturer to clean parts, prepare surfaces for casting, molding or coating or to remove wax, polishing compounds, temporary cement, etc.

The small-scale steam generation units presently on the market are complex, expensive; require a large amount of space both on top of and under a bench and consume excessive energy if they are kept on constantly in order to provide quick steam response when intermittently needed during the course of a manufacturing operation.

STATEMENT OF INVENTION

A small, compact, efficient and low cost vapor generating unit is provided in accordance with this invention. The unit provides rapid warmup, instant response, is simple and economical to operate and uses line power and tap water.

The steam generator of the present invention simply comprises a closed, cylindrical metal helix formed from a continuous small diameter tube. The inlet end of the helix contains flow control means and the outlet end contains a nozzle. Heating means such as a cartridge heater is provided for vaporizing liquid within the helix controlled by at least two thermostats provided at the cold and hot ends of the helix. This provides rapid response at startup, prevents burnup at low rates and permits idling of the device with low power demand.

These and many other features and attendant advantages of the invention will become readily apparent as the invention becomes better understood by reference to the following detailed description when considered in conjunction with the accompanying drawings.

DESCRIPTION OF PREFERRED EMBODIMENTS

Figure 1:
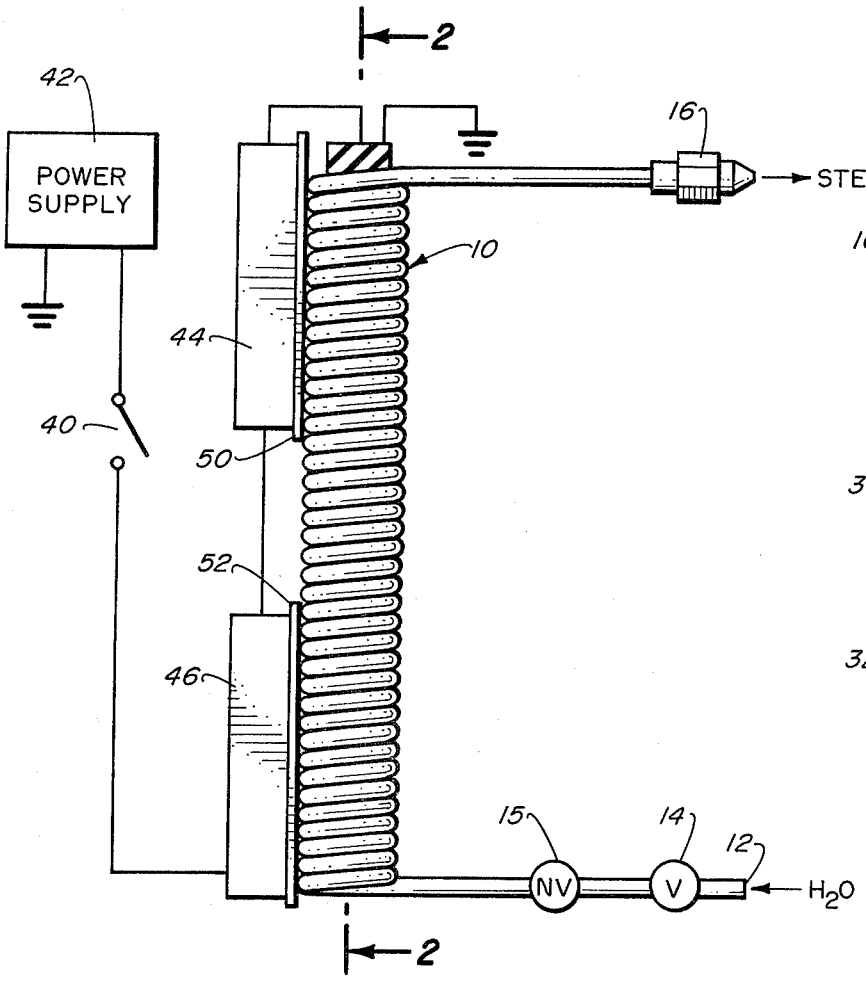
FIG. 1 is a schematic view of an embodiment of a steam generation unit in accordance with this invention.
Figure 2:
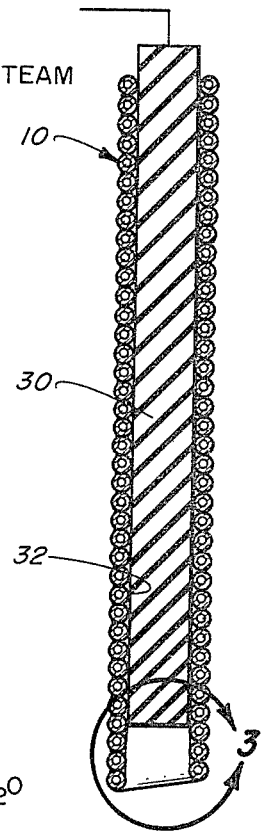
FIG. 2 is a view in section taken along line 2—2 of FIG. 1.
Figure 3:
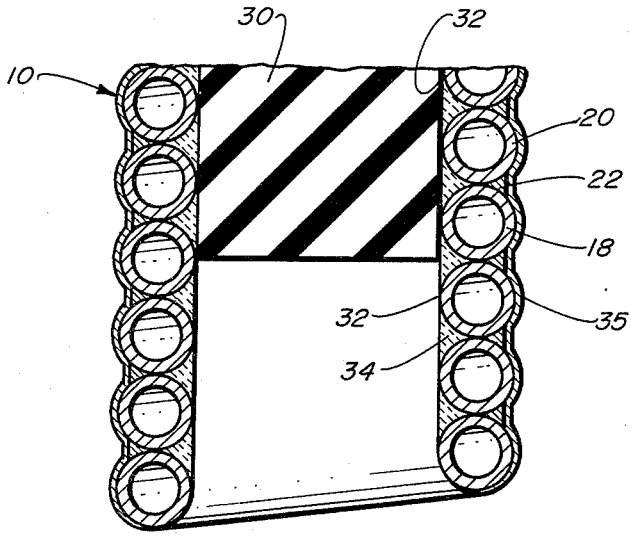
FIG. 3 is an enlarged section taken along line 3 of FIG. 2.

Referring now to FIGS. 1–3, the steam generator of the invention includes a heat exchanger 10 in the form of a continuous helix having an inlet end 12 containing an adjustable valve 14, an on-off valve 15 and an outlet end containing a nozzle 16. Each revolution 18 of the helix is in tangential contact with the next revolution 20 and the revolutions are joined by brazing, welding or soldering 22 or other fusion process to provide a structurally rigid, fluid tight, closed cylindrical member having improved thermal conductivity.

A heat source may be provided internally or externally to the surface of the helical tube carrying water to generate steam such as by means of a heat exchange fluid such as liquid metal or by means of combustion gases. A preferred, heating means for a compact table top unit is a cartridge heater 30 having a diameter equal to the internal diameter of the helix 10 and inserted into the helix. The cartridge heater 30 is recessed 3–7 coils from the cold end of the helix. Since the heater is only in point contact with the inner surface 32 of the coils, thermal efficiency is improved by increasing the heat transfer surface by applying a coating 34 of a heat conductive paste to the inner surface 32 of the helix. Thermal efficiency is further improved by applying to the outside surface of the helix a thin coating 35 of a heat resistant, reflective paint such as aluminum automotive manifold paint.

The power and control circuit for the generators comprises an unmodulated power supply 42 suitably line AC (110 V, 1000 watts), connected in series with a switch 40, a cold end thermostat 46, a hot end thermostat 44 and the cartridge heater 30. The thermostats 44, 46 are mounted on metal plates 50, 52 respectively attached to the coils. The thermostats are set in a disable mode and are set at a positive differential of from 10° to 40° F. The cold end thermostat is typically set at a temperature of at least 385° F.

For effective heat transfer, the ratio of the area, A, of the heated surface to the volume, V, of a contained fluid, A/V, should be a maximum. For a cylindrical container (the small diameter tubing) with hot walls, $A/V=2/r$ where r is the radius of the cylindrical container. From this it is evident that the tubing of the helix should be made as small as is practical. In areas having hard water a helix formed of copper tubing having $\frac{1}{8}$ inch outside diameter tended to clog. Units having outside diameters of 3/16 inch provided continuous trouble-free operation. The wall thickness of copper tubing in this outside diameter (O.D.) range is typically about 0.030 inch.

An embodiment of a steam generator in accordance with the invention was assembled by forming 3/16 inch O.D. copper tubing into a cylindrical helix having an internal diameter of about 5/8 inch. The helix was brazed continuously to seal the space between the coils. Copper thermostat mounting plates were brazed to the outside surface and the outside surface coated with an aluminum manifold paint. The interior surface was then coated with a water-based curable clay-filled putty thermal bonding material and an electric resistance cartridge heater was inserted into the helix. The thermostats were mounted and connected to a switch. A needle valve and toggle shut-off valve were connected to the inlet end of the helix and an output nozzle to the outlet end thereof. The helix was then mounted in an insulated housing and the water inlet end of the coil connected to line water and the electrical lead connected to line power.

The power switch 40 and on-off water toggle valve 14 are then operated and needle valve 15 adjusted to provide a desired flow rate and quality of steam. The cold end thermostat will demand power and the cartridge heater will heat the coil to 385° F. to provide superheated wet steam having up to 125° F. superheat at a rate up to 4 pounds per hour. The unit operates with nozzle inlet steam pressure about 10 psi below a typical line pressure of about 70 psi. The unit typically operates with a constant mass flow rate. The pressure gradient for steam is approximately 400 times the pressure gradient for water. Flow instability in the coil requires flow rate control at the liquid entrance, hence the needle valve 15.

The hot end thermostat set at approximately 410° F. prevent burn-up at low flow rates. In fact, the needle valve can be set at an idle position at which little or no steam is generated but the unit is ready to generate steam in a very short time interval after increasing the flow rate. By recessing the heater, the cold end thermostat immediately senses the flow of cold water and turns on the heater quickly. If only the hot end thermostat was used, it would take too long for radial thermal gradients to be established and the unit would flood and never recover. If only the cold end thermostat is utilized, the upper end can melt and destroy the unit. The toggle valve permits memory control of a desired flow rate. When the unit is turned off or idling with only power on, a desired flow rate of steam can be achieved by operating only the water toggle valve.

The steam generator unit of this invention is capable of delivering a fully modulated flow of superheated vapor, various degrees of saturated vapor, and heated liquid. The unit idles (zero flow rate) at an elevated temperature, drawing only sufficient energy to make up losses through the unit's insulation. As cool liquid is admitted, its presence must be promptly detected so that the energy source may be activated promptly to reestablish the temperature gradients required to sustain steady state heat transfer to the vaporizing fluid. In the case of an unmodulated energy source (on-off control) this is achieved by mounting a temperature sensor (thermostat) at the inlet end of the helix. Since the unmodulated energy source will provide the same energy input at all flow rates, low flow rates will result in increased temperatures of the output vapor. Since the heat capacity of the vapor is grossly less than the heat capacity of the boiling liquid, the output end of the helix will experience a continuing increase of temperature until destruction occurs. A second temperature sensor (thermostat) mounted at the output end of the helix senses this increased temperature and acts to arrest the energy input. In cases where the energy source is electric resistance heating at a constant power level along the entire length of the helix, the two thermostats need only be connected in series with the resistance heater, and the inlet thermostat be set to actuate at a temperature slightly below the set temperature of the outlet thermostat. This assures that the inlet thermostat is controlling during periods when the unit is idling and has come to a common temperature throughout, and it, the inlet thermostat, will then most quickly sense the presence of cool liquid.

The steam generator unit of the invention is simple, compact and can be reasonably priced. The unit requires only a small amount of bench space, e.g., 5×6 inches, and no under-bench space. Rapid warmup of from cold start to usable steam in less than 5 minutes is possible and then instantly any time thereafter. Once the unit is at temperature, one need just flip the water toggle valve handle on and steam emerges instantly and continously. Operation is economical since electrical energy is only consumed during warmup and while generating steam. The unit uses regular electric outlet 110 V AC and any tap water. As with any device in which water is evaporated, the dissolved minerals remain to ultimately choke shut the water/steam passage. In areas of hard water, the incoming water is passed through a bed of ion exchange resin which substitutes sodium ions for calcium, magnesium, etc., so that the salts that accumulate within the coil tubing are all sodium based salts which are water soluble. A periodic water flush through the coil effectively removes them. The resin, along with a plastic foam filter element, can be contained in a conditioner unit in the water line and the resin quantity is sized to last about six months, at which time the conditioning unit is discarded and replaced. Demineralized water greatly extends the usable life of the coil assembly.

The unit is especially useful in manual manufacturing operations such as jewelry manufacture to remove wax from castings or impressions, to clean jewelry and to remove polishing compounds from intricate networks. Dental offices and laboratories are another and principal market for the unit in which it will be used for removal of polishing compounds from crowns, bridges, dies; cleaning of models, removal of stickly wax from articulations; removal of temporary cement from crowns; removing wax from denture teeth; cleaning of ceramic frames prior to porcelain application; cleaning of porcelain prior to staining and glazing; and cleaning impression trays.

The unit is generally useful for providing superheated vapors from liquids and could be sealed up for generation of mercury vapors, halohydrocarbon vapors (Freons) for uses from nuclear power generation to a steam generator for an automobile.

It is to be realized that only preferred embodiments of the invention have been described and that numerous substitutions, modifications and alterations are permissible without departing from the spirit and scope of the invention as defined in the following claims.

We claim:

1. A vapor generator comprising in combination:

a heat exchanger in the form of a continuous helix in which each revolution is in tangential contact with the adjacent revolution and the revolutions are joined and sealed to each other, said helix having an inlet end for receiving a flow of vaporizable liquid and an outlet end for emitting vapor; thermal means comprising an electrical resistance cartridge heater inserted into the interior of the helix for applying sufficient heat to a surface of the helix for vaporizing the liquid therein; means for regulating the electrical power supplied to the heater including a first thermostat mounted near the cold inlet end of the helix and a second thermostat mounted near the outlet end of the helix, and means connecting the thermostats in series contact with the heater.

2. A generator according to claim 1 in which a heat conductive paste is applied to the interior surface of the helix to improve thermal contact between the heater and the helix.

3. A generator according to claim 1 in which the heater is recessed 3 to 7 coil revolutions from the inlet end of the helix.

4. A heater according to claim 1 in which the inlet end thermostat is set to cut-off power at a temperature of at least 385° F. and the outlet end thermostat is set to cut-off power at a positive temperature of from 10° F. to 40° F. higher than the set temperature of the cold end thermostat.

5. A generator according to claim 1 further including a coating of heat-resistant reflective paint on the outside surface of the helix.

6. A generator according to claim 1 further including a variable liquid supply valve mounted on the inlet end of the helix.

7. A generator according to claim 6 further including a nozzle mounted on the outlet end of the helix.

8. A generator according to claim 1 in which the revolutions are joined by fusion.

9. A generator according to claim 8 in which the fusion is welding, brazing or soldering.

* * * * *